US007278279B2

(12) United States Patent
Hirai et al.

(10) Patent No.: US 7,278,279 B2
(45) Date of Patent: Oct. 9, 2007

(54) REFRIGERATOR

(75) Inventors: Chie Hirai, Ibaraki (JP); Kenji Takaichi, Yao (JP); Yasuaki Tanimoto, Nishinomiya (JP)

(73) Assignee: Matsushita Refrigeration Co., Osaka (JP)

( * ) Notice: Subject to any disclaimer, the term of this patent is extended or adjusted under 35 U.S.C. 154(b) by 191 days.

(21) Appl. No.: 10/506,760

(22) PCT Filed: Mar. 13, 2002

(86) PCT No.: PCT/JP02/02333

§ 371 (c)(1),
(2), (4) Date: Jun. 9, 2005

(87) PCT Pub. No.: WO03/076855

PCT Pub. Date: Sep. 18, 2003

(65) Prior Publication Data

US 2005/0235682 A1 Oct. 27, 2005

(51) Int. Cl.
*F25D 11/00* (2006.01)
*F25D 11/02* (2006.01)
*A47B 96/04* (2006.01)

(52) U.S. Cl. ..... 62/440; 62/447; 312/401

(58) Field of Classification Search ..... 62/440, 62/441, 443, 447, DIG. 13; 312/400, 401, 312/406, 407; 52/404.1, 406.2, 406.3; 428/69; 220/592.02, 592.09, 592.2
See application file for complete search history.

(56) References Cited

U.S. PATENT DOCUMENTS 2,779,066 A * 1/1957 Gaugler et al. ..... 312/406
5,018,328 A * 5/1991 Cur et al. ..... 52/406.2
5,082,335 A * 1/1992 Cur et al. ..... 312/401
5,512,345 A * 4/1996 Tsutsumi et al. ..... 428/69
5,532,034 A * 7/1996 Kirby et al. ..... 428/69
5,669,232 A * 9/1997 Iwamoto et al. ..... 62/296
5,693,399 A * 12/1997 Himeshima et al. ..... 428/69
5,730,516 A * 3/1998 Vismara ..... 312/406
5,866,228 A * 2/1999 Awata ..... 428/69
5,943,876 A * 8/1999 Meyer et al. ..... 62/371
6,109,712 A 8/2000 Haworth et al.
6,128,914 A * 10/2000 Tamaoki et al. ..... 62/440
6,266,941 B1 * 7/2001 Nishimoto ..... 52/788.1
6,375,292 B2 * 4/2002 Nishimoto ..... 312/406
6,938,968 B2 9/2005 Tanimoto et al.

FOREIGN PATENT DOCUMENTS

EP 0 587 548 A1 3/1994

(Continued)

OTHER PUBLICATIONS

Supplementary European Search Report for EP 02 70 5108, dated Oct. 11, 2005.

*Primary Examiner*—Mohammad M. Ali
(74) *Attorney, Agent, or Firm*—RatnerPrestia

(57) ABSTRACT

A heat insulating box of a refrigerator includes a non-flammable heat-insulator particularly a vacuum heat-insulator made of a board-shape molded inorganic fiber. Therewith non-flammability of the heat insulator is ensured and a refrigerator box prevented from catching an outside caused fire is achieved, thus a refrigerator which is safe even when a flammable refrigerant is used and which is high in energy-saving is provided.

10 Claims, 3 Drawing Sheets

FOREIGN PATENT DOCUMENTS

| | | | | |
|---|---|---|---|---|
| EP | 0 756 142 | A2 | | 1/1997 |
| GB | 730114 | A | | 5/1955 |
| JP | 8-14733 | A | * | 1/1996 |
| JP | 10-44290 | A | | 2/1998 |
| JP | 11-60758 | | | 3/1999 |
| JP | 2001-133135 | A | | 5/2001 |
| JP | 2001-165389 | A | | 6/2001 |
| JP | 2001-165557 | | | 6/2001 |
| JP | 2001-165557 | A | * | 6/2001 |
| WO | WO 98/34077 | | | 8/1998 |
| WO | WO 01/81817 | A1 | | 11/2001 |

* cited by examiner

REFRIGERATOR

TECHNICAL FIELD

This invention relates to a refrigerator, which safety is enhanced by securing non-flammability of a heat-insulator and which energy saving property is enhanced by improving non-flammability of the heat-insulator.

BACKGROUND ART

A conventional refrigerator cools or freezes foodstuff by having an evaporator constituting a refrigeration cycle in a space formed by a refrigerator box, and disposing a heat insulating material in the box for insulating a cool air produced by the evaporator from an outside air.

Recently, a vacuum heat-insulator having a high heat-insulating characteristic is attracting a public attention from energy-saving and space-saving standpoints. Examples of such vacuum heat insulators are such as one which core material is made of hard-urethane-foam having continuous foam, covered by a gas-barring laminated film and then inside is vacuumed, and another one which inorganic material powder is filled in an inside bag, and the bag is put in an outside bag and then the outside bag is decompressed. Heat-insulating characteristic of those vacuum insulators is 2.5 times higher than that of foam resin insulator composed of hard or soft urethane-foam material.

The foam resin material used in the conventional refrigerator is not so effective as to prevent the heat-insulating material from burning from a fire, if a fire is broken out near the refrigerator and the heat-insulating box catches the fire. Using a vacuum heat-insulator having a high heat-insulating characteristic is an effective way for a refrigerator to enhance energy-saving characteristic and increase a storage capacity of the refrigerator. However, the vacuum heat-insulator using the foam resin as a core material does not much contribute to increasing non-flammability of the refrigerator. If a vacuum heat-insulator employs an inorganic-material powder, non-flammability of the insulator increases, however, because the material is hard to be molded into a heat-insulator, it is difficult to be used for a heat-insulator of a refrigerator. Moreover, as flammable hydrocarbon (HC) refrigerant is started to be used for preventing global warming, a refrigerator avoided from catching a fire is becoming more important. Yet the conventional heat-insulating material does not comply with such requirement.

The present invention is aimed to solve above conventional tasks and to provide a refrigerator which is safe for using a flammable refrigerant and high in energy saving property. The refrigerator uses a non-flammable vacuum heat-insulator made of a board-shape molded inorganic fiber in the refrigerator box, thus preventing the refrigerator box from catching an outside fire.

SUMMARY OF THE INVENTION

In order to solve above tasks, a heat-insulator of the refrigerator in the invention includes a vacuum heat-insulator which is composed of a board-shape molded inorganic fiber covered by a gas-barring film and evacuating inside, a foam resin heat-insulator in its heat insulating box. Having the non-flammable vacuum heat-insulator composed of the board-shape molded inorganic fiber, non-flammability of the heat-insulating box is enhanced higher than a heat-insulating box having only of the foam resin. Non-flammability of the heat insulating box against an outside fire is thus improved, a refrigerator having a higher safety than a conventional refrigerator is provided.

Because the vacuum heat-insulator is disposed inside the heat insulating box reducing usage of the foam-resin in the box, enhancing the non-flammability of the heat-insulating box, a wall of the heat insulating box can be thinned so that a total amount of the foam-resin used in the box can still be reduced. Because the usage amount of the foam resin is reduced, generation of organic gas is avoided even when the insulating material catches a fire, and a much safer refrigerator is realized.

Because the molded board-shape inorganic fiber is used with the heat-insulator, the refrigerating box is made flat in outside surface, light in weight and high in productivity.

The refrigerator in this invention includes heat-insulating materials in a space between an inner box and an outer box, and the vacuum heat-insulator made of the board-shape molded inorganic fiber is placed on the outer box. The vacuum heat insulator is placed on the outer side box of the refrigerator and the vacuum heat-insulator is non-flammable, even when the refrigerator catches an outside fire, foam resin hardly catches the fire because the vacuum heat-insulator is non-flammable, because the vacuum heat-insulator is non-flammable, improving non-flammability of the refrigerator box.

A door also includes the non-flammable vacuum heat-insulator composed of the board-shape molded inorganic fiber, so that non-flammability of the door heat-insulator is enhanced against a fire outside the refrigerator.

The refrigerator also includes a partition box dividing the refrigerator into independent compartments, and the partition box of the refrigerator also includes the vacuum heat-insulator composed made of the board-shape molded inorganic fiber. Because of this structure, even when one of the independent compartments a freezing compartment or a refrigerating compartment catches an outside fire, the non-flammable partition box hardly burns preventing the other compartment catches the fire, thus the refrigerator is given a further enhanced safety.

The refrigerator according to the present invention has the board-shape molded inorganic fiber in the space between the outer box and the inner box constituting the refrigerator box and the space is evacuated. The vacuum space need not include the foaming resin. Because of this reason, non-flammability of the box can be greatly increased. Even when the refrigerator catches a fire, generation of organic-gas from the foam resin is eliminated beforehand, so the safety of the box is greatly enhanced. Besides, the heat insulating box by itself can be a vacuum heat-insulating, so heat insulating characteristic of the refrigerator is greatly increased.

The board-shape molded inorganic fiber includes at least silica. Employing an inorganic fiber including silica, a vacuum heat-insulator having a superior heat-resistance and of low cost can be provided.

The board-shape molded inorganic fiber includes at least alumina. By employing an inorganic fiber including alumina or by increasing the percentage of alumina, non-flammability of the board-shape molded inorganic fiber can be further improved, providing the vacuum heat-insulator with much enhanced non-flammability.

DETAILED DESCRIPTION OF PREFERRED EMBODIMENTS

Exemplary embodiments of the present invention are described hereinafter with reference to the drawings.

First Exemplary Embodiment

Figure 1:
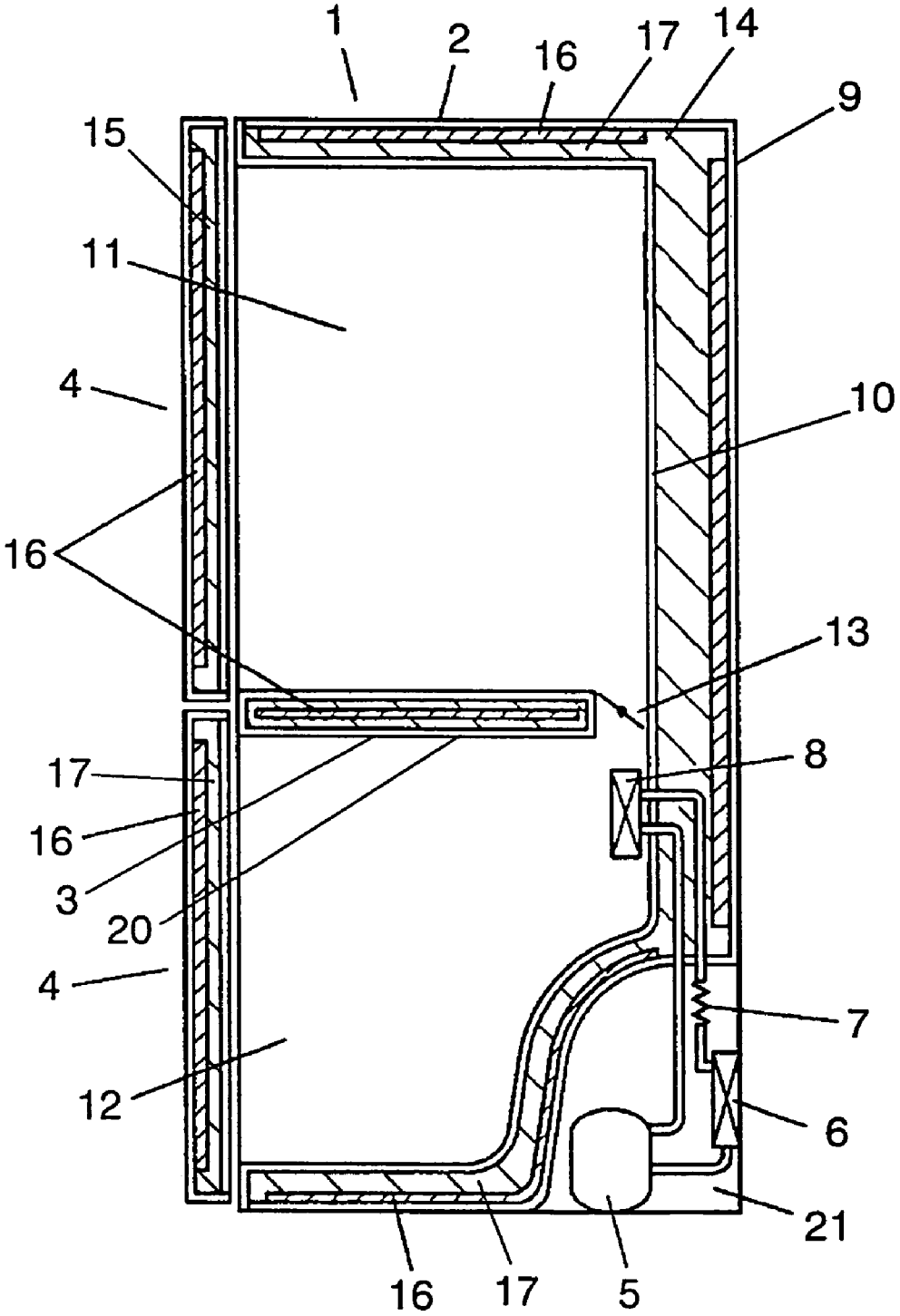
FIG. 1 is a cross-sectional view of a refrigerator in accordance with a first exemplary embodiment of the present invention.

FIG. 1 is a cross-sectional view of a refrigerator in accordance with a first exemplary embodiment of the present invention. Refrigerator main body 1 is composed of heat insulating box 2, partition box 3, door 4, and a refrigeration cycle composed of compressor 5, condenser 6, capillary tube 7 and evaporator 8. Heat insulating box 2 and door 4 are composed of outer box 9 made of press-molded iron plate or the like and inner box 10 is made of molded ABS resin or the like.

A refrigerator space is formed by heat insulating box 2 and door 4. The space is divided into an upper space and a lower space by partition box 3, the upper space being refrigerating compartment 11 and lower space being freezing compartment 12.

Compressor 5, condenser 6, capillary tube 7, and evaporator 8 are linked together constituting the refrigeration cycle. In the refrigeration cycle of the exemplary embodiment of the present invention, isobutene is enclosed as a HC refrigerant. Evaporator 8 sends a cool air into refrigerating compartment 11 through damper 13 placed in freezing compartment 12. Evaporator 8 can be installed in two places, both in refrigerating compartment 11 and freezing compartment 12 connected in series or in parallel forming the refrigeration cycle.

In space 14 of the heat-insulating box and in space 15 in door 4, vacuum heat-insulator 16 and foam resin heat-insulator 17 are placed. Foam resin heat-insulator 17 in this exemplary embodiment is hard urethane foam foamed by a foaming agent cyclopentane. In partition box 3, vacuum heat-insulator 16 is placed.

In vacuum heat-insulator 16 in the exemplary embodiment, a board-shape molded inorganic fiber is used as a core material. The core material is covered by a gas-barring film and inside is vacuumed, providing vacuum heat-insulator 16.

Constituent element of the board-shape molded inorganic fiber is not specifically prescribed, but an inorganic fiber such as of alumina fiber, ceramic fiber, silica fiber, zirconium fiber, glass wool, lock wool, calcium-sulfate fiber, silicon-carbonate fiber, potassium-titanate fiber and magnesium-sulfate fiber can be used. Single material is not a requisition for use. Diameter of the inorganic fiber is preferably 10 μm or less from a standpoint of heat-insulation, more preferably 5 μm or less, most preferably 3 μm or less.

Only the fiber material is employed, but an inorganic binder or an organic binder can be added for forming a collection of the fiber. As the inorganic binder, material such as colloidal silica, water glass, low-melting point glass, alumina sol, silicon resin and other known inorganic binder can be used without restriction.

As the organic binder, thermosetting resin such as phenol resin, epoxy resin, urea resin, acrylic resin including methyl acrylate, ethyl acrylate, butyl acrylate, cyano acrylate, methyl methacrylate, ethyl methacrylate, butyl methacrylate, cyano methacrylate, polyethylene terephthalate, polybutylene terephthalate, polyethrene, polyester including polyethylene naphthalate, polypropylene, polyethylene, polystyrene, poly vinyl acetate, polyvinyl alcohol, polyacrylonitride, and thermosetting resin such as polyamide resin can be used without restriction. Other public known material can also be used with no restriction.

An adding amount of the organic binder is preferred to be 10% or less from standpoints of keeping non-flammability of the inorganic molded fiber, preventing gas generation over time and maintaining a desired density of the material, or more preferably 5% at most. Two or more of binders can be mixed together. Generally used plasticizer, thermal stabilizer, optical stabilizer and filling material can also be mixed. Those materials can be mixed for use or can be diluted with water or with other known organic solvent.

The inorganic fiber material is coated with such binder or with diluted solution of the binder, or the inorganic fiber can be impregnated with the binding material or the diluted solution of it, so that the binder is attached to the inorganic fiber material. If the binder is a diluted solution, the binder is dried out first, and the processed inorganic fiber material is compressed or heat-compressed so as to be made into a molded board-shape inorganic fiber. It is also possible to get such processed fiber by diffusing the inorganic fiber material in the diluted solution of the binder and then filtering the fiber material out.

The density of the board-shape molded inorganic fiber thus produced is, although not specifically designated, preferred to be at least 80 $kg/m^3$ so as it can be formed into a molded unit, and at most 400 $kg/m^3$ so as the heat-insulating property may be retained; most preferably 150 $kg/m^3$ at least and 300 $kg/m^3$ at most.

Figure 2:
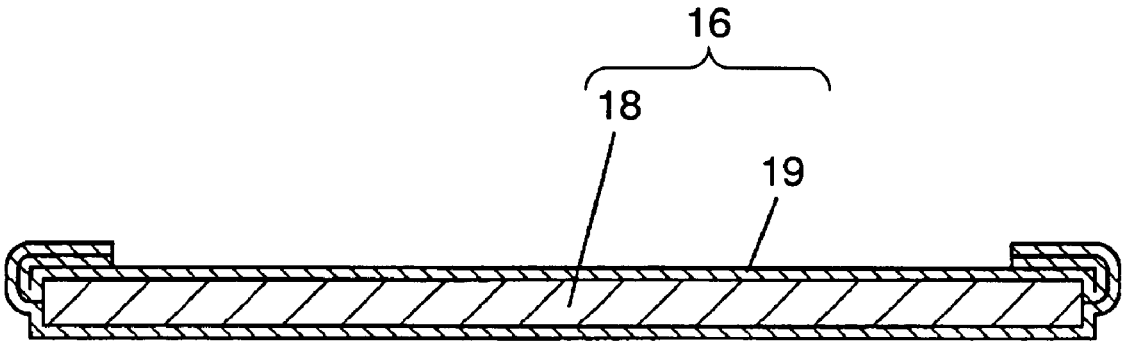
FIG. 2 is a cross-sectional view of a vacuum heat-insulator in accordance with the first exemplary embodiment of the present invention.

FIG. 2 is a cress-sectional view of vacuum heat-insulator 16, which shows that board-shape molded inorganic fiber 18 is placed inside gas-barring film 19 a cover material, and inside is decompressed to approximately down to 30 Pa.

The gas-barring film covers the core material so that inside can be decompressed. Constitutional material of the film is not specifically prescribed, but examples are as follows. Material of an outermost layer is polyethylene terephthalate resin, an intermediate layer is aluminum (hereinafter called AL) foil, and an innermost layer is a plastic laminate film made of high-density polyethylene resin forming a bag. In another example, an outermost layer is polyethylene terephtalate resin, an intermediate layer is ethylene-vinyl alcohol copolymer resin evaporated with AL layer (Kuraray's brand name Eval), and an innermost layer is a plastic laminate film of high-density polyethylene resin forming a bag.

As features of the cover material, the outermost layer endure an outside shock, the intermediate layer securely bars gas, and innermost layer seals the bag with heat. As long as such requirements are satisfied, any known material is allowed to be used. In order to enhance the feature, such as nylon resin can be deposited over the outermost layer strengthening resistance to pricking, or two layers of ethylene vinyl alcohol copolymer resin having an intermediate layer of AL evaporation film can be laid over instead.

For the heat-sealed innermost layer, high-density polyethylene resin is preferred for its sealing characteristic and chemical resistance, but others such as polypropylene resin or polyacrylonitride resin can be used without problem.

Shape of the outside cover is not restricted, but any shape is allowed including four-way sealing bag, gazette type bag, pillow type bag and L-shape.

It is possible to apply heat-treatment to the core material for removing residual water and residual gas before the material is placed inside the cover material. The temperature of heat-treatment shall be preferably 100° C. or more where at least dehydration occurs.

In order to enhance reliability of vacuum heat-insulator 16, a getter material such as a gas-adsorbent and a moisture-adsorbent can be added.

Adsorption mechanism of the getter can be of a physical or a chemical, or the getter can be of an occlusion type or an adsorption type, but in any case material which works as a non-evaporation getter is preferred.

As a physical adsorbent, such as synthetic zeolite, active carbon, active alumina, silica gel, dawsonite, hydrotalcite are more specifically listed.

As a chemical adsorbent, oxide material of alkali-metal or of alkaline-earth metal, hydroxide material of alkali-metal or of alkaline-oxide metal can be listed, especially lithium oxide, lithium hydroxide, calcium oxide, calcium hydroxide, magnesium oxide, magnesium hydroxide, barium oxide and barium hydroxide can be named.

Calcium sulfate, magnesium sulfate, sodium sulfate, sodium carbonate, potassium carbonate, calcium chloride, lithium carbonate, unsaturated fatty acid, and iron compound also effectively work as a getter. Barium magnesium, calcium, strontium, titan, zirconium and vanadium can be used more effectively as a single material or as an alloy. The getters can be mixed in various ways for absorbing and eliminating nitrogen, oxygen, moisture and carbon dioxide.

Thermal conductivity which represents heat-insulating characteristic of vacuum heat-insulator 16 made of the board-shape molded inorganic fiber is 0.0043 W/mK at a decompressed condition of 30 Pa. On the other hand, a thermal conductivity made of the vacuum heat-insulator employing continuous foam urethane or silica powder as a core material is 0.0065 to 0.0075 W/mK at 30 Pa. As shown, heat-insulating characteristic of vacuum heat-insulator 16 in accordance with the exemplary embodiment is approximately 1.5 times higher than the conventional vacuum heat-insulator. Because of its high heat-insulating characteristic, even thin heat-insulator 16 is endowed with a sufficient heat-insulating characteristic, increasing a storage capacity of refrigerator main body 1.

Because vacuum heat-insulator 16 uses the core material made of the board-shape molded inorganic fiber, vacuum heat-insulator 16 is made thin and highly flat, consequently the heat-insulating wall of insulating box 2 is made thin and very flat.

Because of its excellent cutting and bending and because it is easy to form a depression, protrusion and a through-hole, vacuum heat-insulator 16 can well fit into the shape of refrigerator main body 1. For instance, a sheet of vacuum heat-insulator 16 can be placed onto three sides of heat-insulating box 2 of refrigerator main body 1 by bending along the side lines. Being formed into such shape, the vacuum heat insulator can cover edge portions of the refrigerator main body 1, providing heat-insulating box 2 having an excellent non-flammability and heat-insulating characteristic to be used for the refrigerator.

Where a thinner part is required in the wall of heat-insulating box 2, one sheet of the board can be applied there while two sheets be applied to the other part, thus simply achieving a required shape. Because the core material of vacuum heat-insulator 16 is in the board shape, various shape of requirement can be satisfied, while the board can be stacked into a required thickness.

When a pipe or a conductive wire are placed over vacuum heat-insulator 16 as needed by a structure of refrigerator main body 1, depression can be formed in a shape of the pipe or the wire on the board-shape inorganic molded fiber when vacuum heat-insulator 16 is fabricated or after vacuum heat-insulator 16 is fabricated, for the pipe or the wire there to be placed there. It is also possible to press the vacuum heat-insulator directly onto the pipe or the wire laid inside the insulating box, by putting the vacuum heat-insulator 16 directly inside the box. As described, because collected fiber material is used, molding is easy and formation of depression is easy.

Since the vacuum heat-insulator employs the inorganic fiber, deterioration of vacuum heat-insulator 16 due to temperature rise, which is caused when foam resin 17 is foam-filled into space 14 between outer box 9 and inner box 10 of refrigerator main body 1, is controlled within a smaller rang than the vacuum heat-insulator employing the organic core material. When fabricating the vacuum heat-insulator employing the inorganic powder, the inorganic powder must be first put into an inner bag then it is put into the outer cover. This is for preventing the inorganic powder from scattering when the cover is evacuated. Thus, for the powder to be put in an inner bag fabricating the inner bag, the shape of the bag must be properly formed. When the board-shape core material is used, however, the vacuum heat-insulator can be formed in a required shape by just cutting the board-shape core material into the required shape. When the powder material is used in the vacuum heat-insulator, the inner bag is sometimes broken or the powder is off-centered when the bag is formed into a required shape, thus restricting the formation process and deteriorating work efficiency.

Because vacuum heat-insulator 16 is a board-shape molded inorganic fiber, work efficiency is much higher in producing vacuum heat-insulator 16 than when inorganic powder is used. Because the filling process of powder into bag is unnecessary and scattering of powder is prevented, work environment is greatly improved. Moreover, because the core material does not scatter even when vacuum heat-insulator 16 is burst, the refrigerator is scrapped without contaminating work environment, namely the refrigerator using the vacuum heat-insulator 16 can be scrapped without difficulty. Still more, because the core material is composed of the fiber not of the powder, contact points of the fiber are increased and the fiber is easily solidified with the binder, much easily producing the core material.

In the exemplary embodiment, vacuum heat-insulator 16 and foam resin heat-insulator 17 are included in heat insulating box 2. Foam resin heat-insulator 17 is made of hard urethane foam, phenol foam, or styrene foam, although the material is not specifically prescribed. Foaming agent that helps foaming of the hard urethane foam is not specifically prescribed either, but cyclopentane, isopentane, n-pentane, isobutene, n-butaine, water (with bubbles of carbon dioxide), azo compound and argon are preferred because of their ozone layer protection capabilities and earth warming prevention capabilities, and cycropentane is especially recommended for its heat-insulating characteristic.

In the exemplary embodiment, vacuum heat-insulator 16 is disposed on a side of outer box 9 of heat insulating box 2, and foam resin heat-insulator 17 on a side of inner box 10 of the box. Foam resin heat-insulator 17 fills space 14 between outer box 9 and inner box 10 by foaming after vacuum heat-insulator 16 is disposed on inside surface of outer box 9, forming a heat-insulating wall. Otherwise, vacuum heat-insulator 16 and foam resin heat-insulator 17 can be foamed into a piece, and the piece can be placed in space 14 between outer box 9 and inner box 10 so as a side of vacuum heat-insulator 16 may be placed facing outer box 9. By directing non-flammable vacuum heat-insulator 16 toward outer box of refrigerator main body 1, non-flammability of refrigerator main body 1 is further enhanced against an outside fire and the safety of the refrigerator is augmented.

It is also possible to increase non-flammability of entire heat-insulating box 2 by placing multiple pieces of non-flammable vacuum heat-insulator 16 composed of board-shape molded inorganic fiber 18 on a rear side, both sides and a top side of refrigerator main body 1, therewith the safety of the refrigerator is further augmented. By placing the vacuum heat-insulator on one or more places of heat insulating box 2 corresponding to sides, a rear side and a bottom side of freezing compartment 12, the heat-insulator is cost effectively placed and heat-insulating performance is made more effective.

In the exemplary embodiment, door 4 attached to refrigerator main body 1 employs board-shape molded inorganic fiber 18. As one way of using vacuum heat-insulator 16 in door 4, vacuum insulator 16 composed of board-shape molded inorganic fiber 18 can be affixed to one of insides faces of door 4 facing inward or outward, and then foam resin heat-insulator 17 can fill rest of the inside space. In another way, a multilayer heat-insulating panel can be produced with vacuum heat-insulator 16 and foam resin heat-insulator 17, and then the panel can be held inside door 4 or taped inside. Still in other way, board-shape molded inorganic fiber 18 can be directly disposed inside door 4, and then inside door 4 is evacuated, door 4 itself becomes a vacuum heat-insulator. In any case, because non-flammable vacuum heat-insulator 16 or an equivalent is used in door 4, non-flammability of door 4 is achieved preventing refrigerator main body 1 from catching a fire broken near the refrigerator.

The refrigerator in the exemplary embodiment has partition box 3 dividing refrigerator main body 1 into independent compartments. Partition box 3 includes vacuum heat-insulator 16. The partition box can be produced just by placing vacuum heat-insulator 16 inside partition box 3 and covering the box with partition box external frame 20 composed of ABS resin or of PP resin.

The partition box can be as well made by molding altogether the vacuum heat-insulator, the foam resin heat-insulator, and the partition box external frame, or the partition box external frame and the inner box can be molded into a piece making the partition box. The partition box can also be made by producing a heat-insulating board with the vacuum heat-insulator and the foam resin heat insulator first, and then placing the board in the external frame of the pattern box. In any case, as long as the vacuum heat-insulator is made of the board-shape inorganic fiber, other details are not specified. By constituting the partition box as above and disposing the vacuum heat-insulator made of the board-shape inorganic fiber inside the heat-insulating box, even if a fire is broken outside the refrigerator and a front door is opened burning inside, the fire is stopped moving to another compartment because the compartment is detached by the partition box. As above, the refrigerator is insured of a higher safety.

Partition box 3 separates inside refrigerator main body 1 into refrigerating compartment 11 and freezing compartment 12, but their positional relationship is not specified; for instance, the freezer can be one of a top freezer, a middle freezer and a bottom freezer. If the refrigerator is large, a vertical partition box can be installed separating the room into right and left making either one a refrigerator or a freezer.

In the exemplary embodiment, vacuum heat insulator is disposed in a following way. First, a hot-melt is applied to a side of vacuum insulator 16, and the inside of the outer box where vacuum heat-insulator 16 is affixed, or to both places, and then vacuum insulator 16 is press-fixed to heat insulating box 2. Next, foam resin heat-insulator 17 composed of the hard urethane foam is put into space 14 between outer box 9 and inner box 10, foam-filling the space.

When vacuum heat-insulator 16 is affixed to the side part of heat insulating box 2, vacuum heat-insulator 16 is disposed so as to fit into a shape of heat insulating box 2. For instance, vacuum heat-insulator 16 having a notch at right bottom corner as in FIG. 1 is disposed so as to fit into a shape of machinery compartment 21. At this time, the vacuum heat-insulator can cover an entire side part of the heat insulating box, or can cover only part of the insulating box corresponding to freezing compartment 12 which leaks a large amount of heat, or the side part of the heat insulating box can be covered by a plurality of the vacuum heat-insulators.

Vacuum heat-insulator 16, which is placed on the heat-insulating part of heat insulating box 2 detaching machinery compartment 21 in a rear bottom of refrigerator main body 1 from freezing compartment 12, is bent along a shape of machinery compartment 21. Because vacuum heat-insulator 16 is made of molded inorganic fiber 18 as the core material, bending work is easy and productivity is improved.

A fabrication method of vacuum heat-insulator 16 shown in FIG. 2 is described below. After board-shape molded inorganic fiber 18 in a thickness of 5 mm is dried at 140° C. for 1 hour, the dried material is placed in cover material 19, and then inside of which is evacuated and openings are sealed, providing vacuum heat-insulator 16. Chemical ingredients of the inorganic fiber in the board-shape molded inorganic fiber are approximately 60% of silica, approximately 18% of alumina, approximately 17% of calcium oxide, and approximately 5% of other inorganic substance. Diameter of the fiber is 1 to 3 μm approximately. Approximately 5% of acryl binder is added to the compound as a binder. Density of the molded material is 120 kg/m$^3$ in atmospheric pressure.

One side of cover material 19 is made up by a surface protect layer of polyethylene terephthalate (12 μm), an intermediate part of aluminum foil (6 μm), and a heat seal layer of a laminate film of high-density polyethylene (50 μm). Another side a surface protect layer is made of a surface protect layer of polyethylene terephthalate (12 μm), an intermediate part of an aluminum vaporized film of ethylene-vinyl alcohol copolymer resin (15 μm), and a heat seal layer a laminate film of high-density polyethylene (50 μm).

In order to increase a protection capacity of cover material 19 from damage, a nylon resin layer is deposited on the surface-protect layer. Cover material 19 is in a shape of four-way seal bag.

Second Exemplary Embodiment

Figure 3:
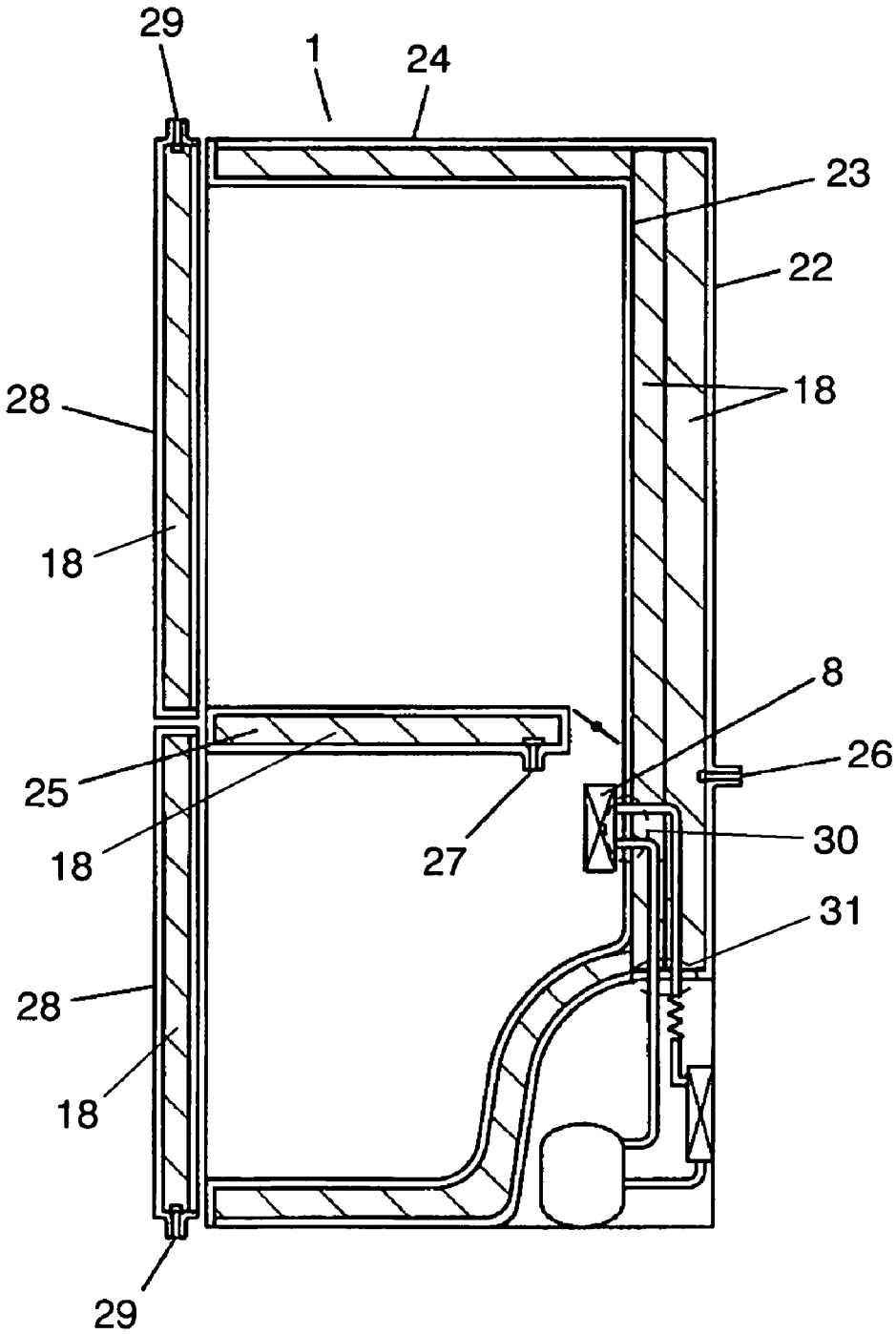
FIG. 3 is a cross-sectional view of a refrigerator in accordance with a second exemplary embodiment of the present invention.

FIG. 3 is a cross-sectional view of a refrigerator in accordance with a second exemplary embodiment of the present invention. Refrigerator main body 1 comprises heat insulating box 24 composed of outer box 22, inner box 23, and board-shape molded inorganic fibers 18 disposed between the outer box and inner box. Heat insulating box 24 includes at least two sheets of board-shape molded inorganic fibers 18. Outer box 22 and inner box 23 are made of a steel plate in a thickness of 0.5 mm, and joints are weld-sealed keeping inside airtight. Partition box 25 is also made of a steel plate, and board-shape molded inorganic fiber 18 is disposed in partition box 25. Outer box 22 and partition box 25 have exhaust vents 26 and 27 for vacuuming inside. After heat insulating box 24 and partition box 25 are vacuumed, exhaust vents 26 and 27 are weld-shielded for keeping inside airtight. When welded, a protrusion of exhaust vent 26 can be cut off for keeping a flatness of a rear plane of the refrigerator as long as the inside is kept airtight. Door 28 is structured by an external frame made of a steel plate in a thickness of 0.5 mm. After board-shape molded inorganic fiber 18 is disposed inside the external frame, inside the door is evacuated and exhaust vent 29 is sealed by welding.

Evaporator 8 is installed inside refrigerator main body 1 and connected to components of external refrigeration cycle through pipes. The pipes and heat insulating box 24 are welded at joint 30 of inner box 23 and joint 31 of outer box 23, keeping heat insulating box 24 airtight.

Board-shape molded inorganic fiber 18 has a depression made along the pipes where they are laid. Because the inorganic fiber is in a board shape, forming the board is very easy and the depression can be formed easily. The inorganic fiber contains approximately 18% of alumina. The higher the aluminum content in the organic fiber, the higher becomes crystallization ratio of the fiber therefore the higher becomes heat-resistant temperature of the fiber. By using board-shape molded inorganic fiber 18 made of an inorganic fiber having a higher percentage of aluminum, the refrigerator is accordingly assured. of an enhanced safety. It is also possible to include a gas absorbent in insulating box 24 and door 28 for keeping inside airtight.

With the structure described above, because the insulating wall does not include foam resin insulator, safety of the refrigerator is greatly enhanced. Even if the refrigerator is caught by an outside fire, the heat insulator does not burn because it does not include an organic insulating material and because organic gas generation from the fiber is prevented with it. The outer box and the inner box are recommended to be produced with a material having a high gas-barring characteristic and a low heat-conductivity, but a metal plate such as a very thin steel plate and a stainless plate are practically and effectively used.

Because the molded board-shape inorganic fiber is disposed between the outer box and the inner box, flatness of the heat insulating box is maintained. Flatness of the surface of the refrigerator is thereby maintained even after the space between outer box and inner box is evacuated. In addition to it, because only the board-shape molded inorganic fiber is placed in-between the inner box and the outer box and the inside space is evacuated, productivity and work efficiency are enhanced higher than when an inorganic powder is used. Still more, because an inorganic fiber is used, gas generation from the vacuum heat-insulator over time is controlled to be small, and long term reliability of the heat insulating box is provided.

Composing the board-shape molded inorganic fiber includes at least silica, therewith heat-resistance of the board-shape molded inorganic fiber can be increased and a low cost of the product is achieved.

The larger the aluminum content is, the higher becomes the heat-resistance of the heat-insulating material. Therefore, by adding at least aluminum to the board-shape molded inorganic fiber, non-flammability of the board-shape molded inorganic fiber is enhanced. The board-shape molded inorganic fiber can contain other non-organic ingredients such as calcium oxide, magnesium oxide, iron oxide, titanium oxide, boron oxide, sodium oxide, zirconia, calcium sulfide, magnesium sulfide, silicon carbide, potassium titanate, chromium oxide and zinc oxide, although the material is not limited to them.

The refrigerator in the exemplary embodiment employs HC refrigerant, a refrigerant less affecting global warming.

When this kind of flammable refrigerant is used, countermeasures against a fire become more important than when conventional HCFC refrigerant or FC refrigerant are used. By using the heat-insulator made of an inorganic molded fiber as is demonstrated in the exemplary embodiment, a refrigerator having a high degree of safety can be provided. Namely, a refrigerator satisfying both requisitions for safety and earth environmental protection are provided.

INDUSTRIAL APPLICABILITY

As described, a heat-insulating box of the refrigerator in accordance with the exemplary embodiment of the present invention includes a vacuum heat-insulator composed of a board-shaped molded inorganic fiber covered by a gas-barring film and decompressed inside. With this construction, non-flammability of the heat-insulator is enhanced higher than a heat-insulator employing foam resin and non-flammability of the heat-insulating box is enhanced. Because the non-flammability of the heat-insulating box against an outside fire is achieved, a much safer refrigerator than a conventional refrigerator is provided.

The invention claimed is:

1. A refrigerator comprising:

a refrigeration cycle composed of a compressor, a condenser, a capillary tube and an evaporator linked together forming a cycle;

a heat insulating box including a heat-insulator, the heat-insulator is disposed in a space between an inner box facing inward of the refrigerator and an outer box facing outward of the refrigerator, in which the space is sealed and decompressed; and a board-shape molded inorganic fiber disposed in the space as a heat insulator; and a flammable refrigerant enclosed in the refrigeration cycle.

2. The refrigerator according to claim 1, wherein the board-shape molded inorganic fiber includes at least silica.

3. The refrigerator according to claim 1, wherein the board-shape molded inorganic fiber includes at least alumina.

4. The refrigerator according to claim 1, wherein the heat insulating box does not include a foam resin insulator.

5. The refrigerator according to claim 4, wherein the density of the board-shape molded inorganic fiber is at least 80 $kg/m^3$ and at most 400 $kg/m^3$.

6. The refrigerator according to claim 4, wherein the density of the board-shape molded inorganic fiber is at least 150 $kg/m^3$ and at most 300 $kg/m^3$.

7. The refrigerator according to claim 4, wherein the heat insulating box additionally includes a gas absorbent.

8. The refrigerator according to claim 4, wherein the board-shape molded inorganic fiber is not placed in a gas-barring film.

9. The refrigerator according to claim 1, wherein the board-shape molded inorganic fiber is not placed in a gas-barring film.

10. The refrigerator according to claim 1, wherein the heat insulating box does not include an organic insulating material.

* * * * *

UNITED STATES PATENT AND TRADEMARK OFFICE

CERTIFICATE OF CORRECTION

PATENT NO. : 7,278,279 B2
APPLICATION NO. : 10/506760
DATED : October 9, 2007
INVENTOR(S) : Chie Harai et al.

It is certified that error appears in the above-identified patent and that said Letters Patent is hereby corrected as shown below:

On the Title Page, Item -56-
At OTHER PUBLICATIONS, enter -- International Search Report for PCT/JP02/02333 dated June 25, 2002 --.

Page 2 Title Page Item -56-
At FOREIGN PATENT DOCUMENTS, delete "JP 2001-165557 6/2001".

Signed and Sealed this

Twentieth Day of May, 2008

JON W. DUDAS
*Director of the United States Patent and Trademark Office*